US007303465B2

(12) United States Patent
Pourdeyhimi et al.

(10) Patent No.: US 7,303,465 B2
(45) Date of Patent: Dec. 4, 2007

(54) HYDROENTANGLING JET STRIP DEVICE DEFINING AN ORIFICE

(75) Inventors: Behnam Pourdeyhimi, Cary, NC (US); Hooman Vahedi Tafreshi, Raleigh, NC (US)

(73) Assignee: North Carolina State University, Raleigh, NC (US)

( * ) Notice: Subject to any disclaimer, the term of this patent is extended or adjusted under 35 U.S.C. 154(b) by 377 days.

(21) Appl. No.: 11/008,583

(22) Filed: Dec. 9, 2004

(65) Prior Publication Data

US 2006/0124772 A1 Jun. 15, 2006

(51) Int. Cl.
*B24C 5/04* (2006.01)

(52) U.S. Cl. ..... 451/102; 451/40

(58) Field of Classification Search ..... 451/102, 451/75, 38–40; 28/104–106, 167; 239/266, 239/533, 554–557, 566, 553.3, 553.5, 591
See application file for complete search history.

(56) References Cited

U.S. PATENT DOCUMENTS 3,403,862 A * 10/1968 Dworjanyn ..... 239/566
4,805,275 A 2/1989 Suzuki et al.
4,880,168 A * 11/1989 Randall et al. ..... 239/553.5
6,063,717 A * 5/2000 Ishiyama et al. ..... 442/387
6,668,436 B2 12/2003 Noelle et al.
2004/0010894 A1* 1/2004 Goldwasser et al. ..... 28/104
2005/0273989 A1* 12/2005 Dixon et al. ..... 28/104

FOREIGN PATENT DOCUMENTS

WO WO 2005/123616 A2 12/2005
WO WO 2006/063110 * 6/2006

OTHER PUBLICATIONS

Begenir et al., "The Role of Orifice Design in Hydroentanglement", Master of Science Thesis, North Carolina State University, Raleigh. 2002.
Ghassemieh et al., "Effect of Nozzle Geometry on the Flow Characteristics of Hydroentangling Jets", *Textile Res. J.*, 2003, pp. 444-450, vol. 73 No. 5.
Tafreshi et al., "The Effects of Nozzle Geometry on Waterjet Breakup at High Reynolds Numbers", *Experiments in Fluids*, 2003, pp. 364-371, vol. 35.

* cited by examiner

*Primary Examiner*—Dung Van Nguyen
(74) *Attorney, Agent, or Firm*—Alston & Bird LLP

(57) ABSTRACT

A hydroentangling jet strip device is provided, wherein such a device comprises a plate member having opposing sides and defining at least one nozzle orifice extending between the opposing sides. Each of the at least one nozzle orifice includes an axially-extending capillary portion having an aspect ratio between a length of the capillary portion and a diameter of the capillary portion, wherein the aspect ratio is less than about 0.70 so as to be capable of providing a cavitation-free constricted waterjet.

17 Claims, 12 Drawing Sheets

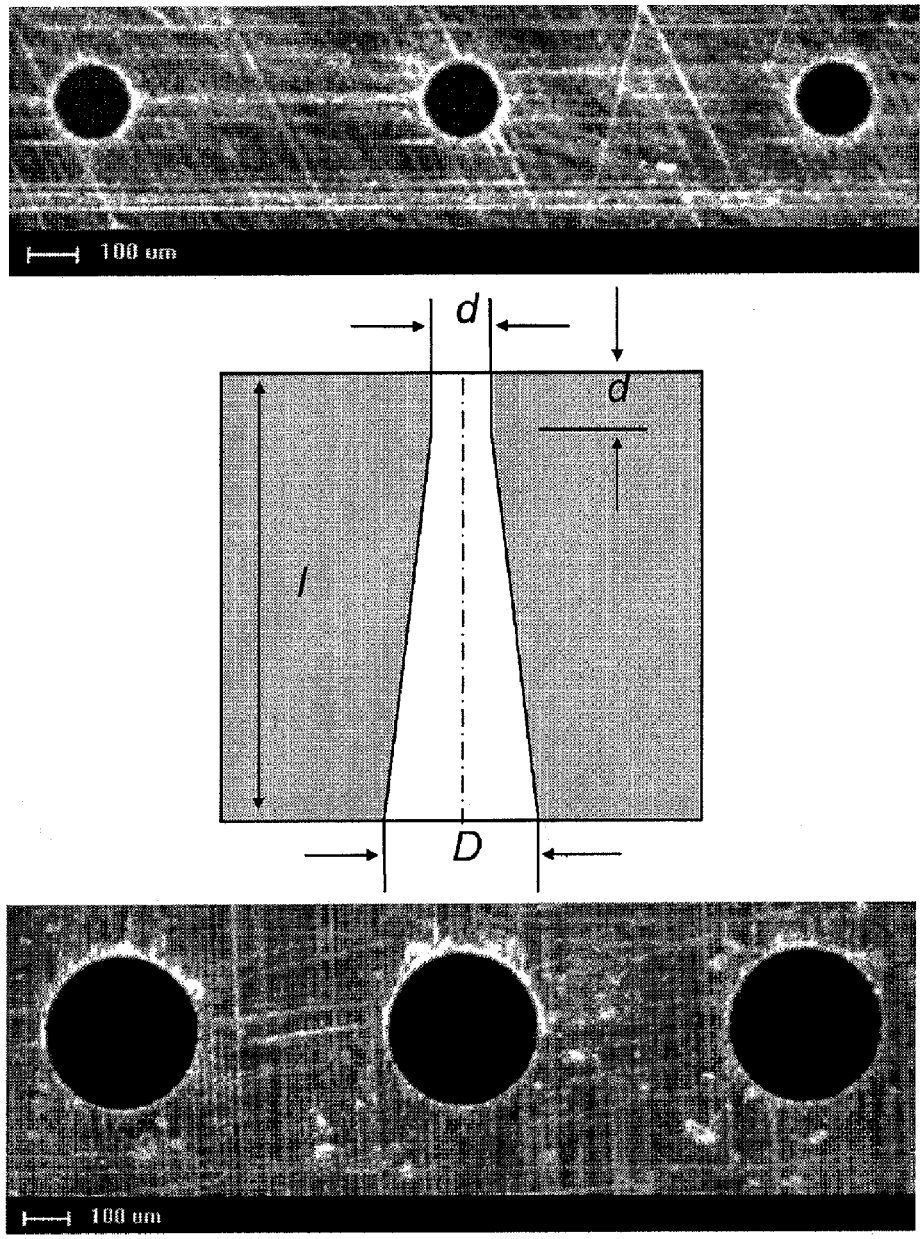
FIG. 1 : Prior Art

FIG. 2a : Prior Art
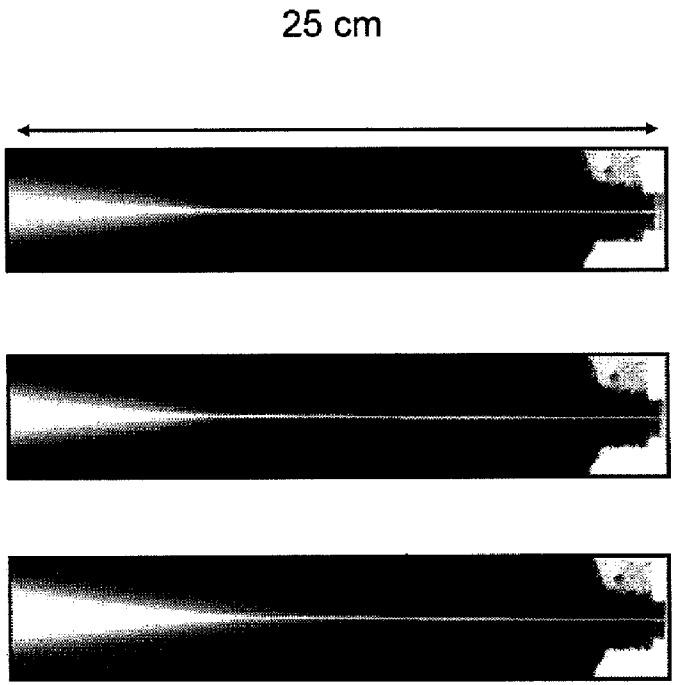
FIG. 2b : Prior Art
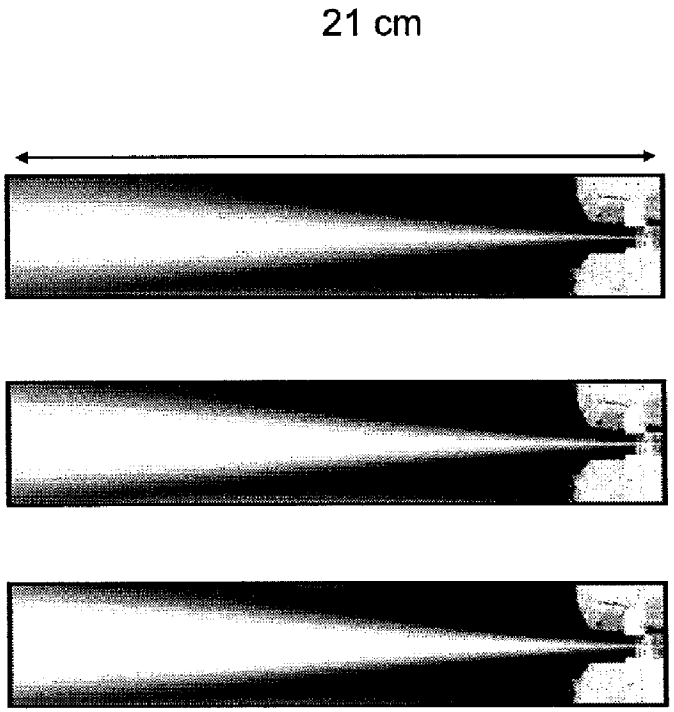

FIGS. 3a-3e: Prior Art

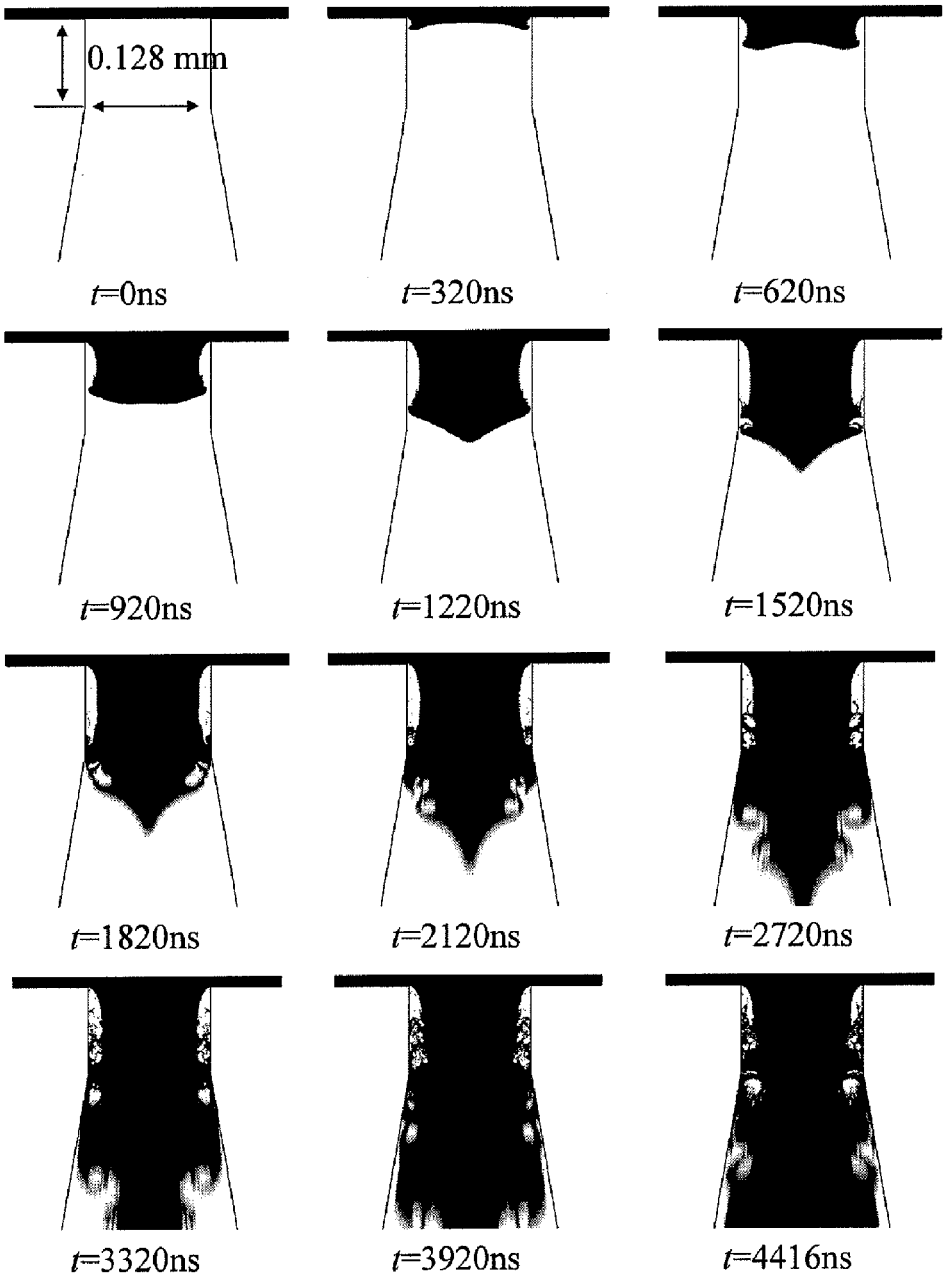
FIG. 4 : Prior Art

HYDROENTANGLING JET STRIP DEVICE DEFINING AN ORIFICE

BACKGROUND OF THE INVENTION

1. Field of the Invention

The present invention relates to a hydroentangling process and, more particularly, to particular configurations of an orifice-type jet strip device used in a hydroentangling process.

2. Description of Related Art

Hydroentanglement or "spunlacing" is a process used for mechanically bonding a web of loose fibers to directly form a fabric. Such a class of fabric belongs to the "nonwoven" family of engineered fabrics. The underlying mechanism in hydroentanglement is the subjecting the fibers to a non-uniform pressure field created by a successive bank of high-velocity waterjets. The impact of the waterjets with the fibers, while the fibers are in contact with adjacent fibers, displaces and rotates the adjacent fibers, thereby causing entanglement of the fibers. During these relative displacements of the fibers, some of the fibers twist around others and/or inter-lock with other fibers to form a strong structure, due at least in part, to frictional forces between the interacting fibers. The resulting product is a highly compressed and uniform fabric formed from the entangled fibers. Such a hydroentangled fabric is often highly flexible, yet very strong, generally outperforming woven and knitted fabric counterparts in performance. The hydroentanglement process is thus a high-speed low-cost alternative to other methods of producing fabrics. Hydroentanglement machines can, for example, run (produce the fabric) as fast as about 700 meters of fabric or more per minute, wherein the fabric may be, for instance, between about 1 and about 6 meters wide. In operation, the hydroentanglement process depends on particular properties of coherent high-speed waterjets produced by directing pressurized water through special nozzles.

Axially-extending hydroentangling nozzles are traditionally made up of two sections or portions. A cylindrical section (capillary portion) typically comprises the fluid inlet to the nozzle and having a diameter, for example, of about 120 microns. The capillary portion is fluidly connected to a cone portion having, for instance, a cone angle of about 15 degrees, though the cone angle may vary considerably. In practice, hydroentangling waterjets are emitted through one or more relatively thin plate strips on the order of between about 1 meter and about 6 meters long, and having between about 1600 and about 2000 orifices or nozzles per meter (see, e.g., FIG. 1). Manufacturing thousands of such small orifices or nozzles in close proximity to each other results in many constraints on the design process for the device. Typically, a jet strip is in the form of a thin-plate strip having a thickness, for example, of about 1 millimeter. Such manufacturing limitations are in part, responsible for the cone-capillary geometry that has generally been used since the inception of hydroentangling process. While this jet strip geometry has worked well in the past thirty years, changes in process parameters have resulted in a need for an improved and more durable jet strip. For example, the operating pressures employed in the hydroentangling process for forcing the fluid through the orifices or nozzles in the plate strip have increased from about 100 bars to over 500 bars. Due to the forces, imparted to the jet strip by the increased pressure of the pressurized fluid, the jet strip (nozzles) tends to wear on an accelerated basis. Additionally, such higher fluid pressures may also lead to a different profile of the waterjet for the same nozzle geometry. Accordingly, process and conditions that worked well for nozzles at low fluid pressures need to be modified for high-pressure waterjets produced through the nozzles, thereby indicating that existing orifice (nozzle) geometries or other configurations are not optimal for high-pressure waterjets.

The geometry of the orifice (also referred to herein as "nozzle" or "nozzle orifice") generally has a significant impact on the coherence of the discharged waterjets (see, e.g., Lin S. P., Reitz R. D. (1998), Drop and spray formation from a liquid jet, Ann. Rev. Fluid Mech., Vol. 30; Wu P.-K., Miranda R. F. and Faeth G. M. (1995) Effects of initial flow conditions on primary breakup of non-turbulent and turbulent round liquid jets, *Atomization and sprays*, Vol. 5, pp. 175-196; or Vahedi Tafreshi H. and B. Pourdeyhimi (2003) "Effects of Nozzle Geometry on Waterjet Breakup at High Reynolds Numbers", *Experiments in Fluids*, (35) 364-371). In the case of a sharp-edge waterjet orifice, a jet strip in the form of a plate separates a pressurized body of water (in a manifold or other suitable device) from the downstream air (the hydroentanglement process area), and the nozzles extend through the major surfaces of the plate, from the pressurized body of water to the downstream air, with a sharp transition between the major surface of the plate facing the body of water and the respective nozzle. The pressurized water thus enters the nozzle in a water flow, wherein the sharp edge causes the flow to detach from the nozzle wall at the fluid inlet (capillary portion) of the nozzle and form a vena contracta (necked configuration) upon entry into the capillary portion. Depending on the length of the capillary portion and the hydrodynamics or other parameters of the water flow, the water flow may or may not reattach to the wall after some distance (see, e.g., Lefebvre A. H. (1989) Atomization and Sprays" Hemisphere Publishing Corporation; or Bayvel, L., and Orzechowski Z. (1993) Liquid Atomization, Taylor & Francis).

Detached flows have certain characteristics that make such flows beneficial in some applications. In the case of detached flows, there is an air gap between the liquid and the capillary wall, generally following the fluid entrance or inlet into the capillary. This air may tend to envelop the liquid flow all the way through the capillary and thus may not allow any contact between liquid phase flow and the capillary wall. Accordingly, in such an instance, wall-induced friction and cavitation do not disturb the structure of this flow. A waterjet resulting from such a detached flow, also termed a constricted waterjet, has a higher stability and therefore, a longer breakup length (see, e.g., Hiroyasu H. (2000), Spray Breakup Mechanism from the Hole-type Nozzle and Its Applications, *Atomization and Sprays,* Vol. 10, pp. 511-521; or Vahedi Tafreshi and Pourdeyhimi 2003). The constricted waterjets may stay laminar even at relatively high Reynolds numbers, as opposed to non-constricted waterjets. FIG. 2 shows a graphical comparison between constricted and non-constricted waterjets issued at the same Reynolds number.

A constricted jet is formed when the water flow enters the capillary portion of a cone-capillary type nozzle shown, for example, in FIG. 1. A non-constricted jet is formed when water enters such a nozzle from the conical side. Such configurations are herein referred to as cone-down and cone-up type nozzles, respectively. The apparently unbroken portion of the constricted waterjet shown, for example, in FIG. 2*a* is not actually a continuous jet of water. Such a statement is evidenced in FIG. 3 where the image of FIG. 2 is juxtaposed with high-speed images taken at three different locations along the waterjet. As shown in FIG. 3, the constricted waterjet includes a continuous region (FIG. 3*b*), a discrete region (FIG. 3*c*), and a spray region (FIGS. 3*d* and 3*e*). In the discrete region, the waterjet is primarily broken (i.e., broken into large droplets). Following the discrete region, large droplets appear, possibly as a secondary breakup resulting from the primary breakup, and the result is a spray of very fine droplets. Such fine droplets are shown in the pictures of the waterjet in FIGS. 3*d* and 3*e*. FIG. 3*d* illustrates the "bag breakup" or secondary breakup of the large drops resulting from the primary breakup.

Generally, the discharge coefficient of a nozzle, defined as the ratio of the real (experimental) flow rate from a nozzle to the flow rate calculated by using the inviscid one-dimensional flow theory (Bernoulli equation), is about 0.62 and 0.92, depending on whether the flow is detached or not, respectively (see, e.g., Ohm, T. R., Senser, D. W., and Lefebvre, H. (1991) "Geometrical effects on discharge coefficients for plain-orifice atomizers", *Atomization and Sprays,* 1, pp. 137-153). With this in mind, A Computational Fluid Dynamics (CFD) code from Fluent Inc. was used to solve the unsteady state Reynolds-Averaged Navier-Stokes equations (RANS) in an axi-symmetric geometry. It was observed that, when water starts flowing into the capillary, initially filled with air, the water becomes detached from the capillary wall since the water, prior to the capillary inlet, gains momentum along the surface of the nozzle plate contacting the water source. The momentum of the water does not allow the water flow to perfectly follow the sudden 90-degree turn transition between the plate surface and the capillary wall. In this regard, FIG. 4 shows the frontline of a waterjet after entering a capillary portion of a nozzle, over a time sequence, for a Reynolds number of Re=21250, with detachment of the water flow from the capillary wall. More particularly, after about 1.2 microseconds, the frontline of the water jet enters the conical portion of the nozzle, but the water flow also reattaches to the capillary wall before completely progressing into the cone portion. Once the water flow reattaches to the nozzle wall, a re-circulating ring of air becomes entrapped inside the nozzle, between the detachment and reattachment points of the water jet. The air bubble will subsequently break up and the re-circulating air zone will become filled by water. The breakup of the air ring and dispersion thereof into the liquid phase, as shown in the latter stages of FIG. 4, causes a relatively large amount of disturbance and turbulence, which perturbs the integrity and collimation of the forming waterjet. Accordingly, once the reattachment of the water flow to the nozzle wall occurs, the waterjet will no longer be laminar and glassy through the nozzle.

The reattachment-induced breakup occurrence in a cone-capillary type nozzle, however, is typically not expected to occur in a conical type nozzle, as shown in FIG. 5*a*. The water flow progression shown in FIG. 5*a* is representative of a conical type nozzle having an inlet diameter of about 128 microns and 15-degree cone angle, operating with a Reynolds number of Re=21250. The air circulation inside the conical type nozzle is represented by the velocity vectors in FIG. 5*b*, after 1.6 microseconds of operation. The formed air gap thus envelops the waterjet and protects the water flow from nozzle wall-induced turbulence (see, e.g., Vahedi Tafreshi H. and B. Pourdeyhimi (2003) "Effects of Nozzle Geometry on Waterjet Breakup at High Reynolds Numbers", *Experiments in Fluids,* (35) 364-371).

A reduction in the pressure of the water flow generally occurs in the separated (detached), but liquid-filled, region formed after the water flow enters the sharp-edged nozzle. If, however, the water flow velocity is high enough to cause the pressure on the separated or detached region to drop down to the water vapor pressure, vaporization will occur and a cavitation pocket will form (see, e.g., Knapp R. T., Daily J. W., and Hammitt F. G (1970) Cavitation, McGraw-Hill Inc.). Such cavitation disturbs the flow pattern within the nozzle (see, e.g., Schmidt D. P., Rutland C. J., Corradini M. L., Roosen P., and Genge O. (1999), Cavitation in Two Dimensional Asymmetric Nozzles, SAE Technical Series 1999-01-0518; Badock C., Wirth R., Fath A., Leipertz A. (1999), "Investigation of cavitation in real size diesel injection nozzles" *International Journal of Heat and Fluid Flow,* 20, 538-544; or Chaves, H., Knapp, M., Kubitzek, A., Obermeier, F., and Schneider T. (1995), Experimental Study of cavitation in the Nozzle Hole of Diesel Injectors Using Transparent Nozzles, SAE Papers, 1995-0290). With respect to the configuration shown in FIG. 4, when the water flow reattaches to the nozzle wall and the air ring becomes filled with water, cavitation starts in the initially air-filled recirculation zone. Cavitation bubbles can significantly disturb the steadiness of the nozzle water flow, and causes turbulence that accelerates the disintegration of the waterjet. If the rate of cavitation is so intense that cavitation cloud grows and reaches the nozzle outlet, the downstream air will flow up to the nozzle (against the water flow) and fill the low-pressure vapor/liquid filled re-circulation region (see, e.g., FIG. 6; Vahedi Tafreshi H. and Pourdeyhimi B. (2004a), Simulation of Cavitation and Hydraulic Flip inside Hydroentangling Nozzles, *Textile Research Journal* 74(4) 359-364; or Vahedi Tafreshi H. and Pourdeyhimi B. (2004b), Cavitation and Hydraulic Flip, *FLUENT News,* 13(1) 38). Once the reverse air flow occurs, the water flow will no longer be in contact with the capillary wall in the re-circulation zone. Therefore, cavitation ceases, a stable undisturbed stream of water flows through the nozzle, and a constricted waterjet forms. This phenomenon is otherwise referred to as "hydraulic-flip."

Generally, over a relatively long time ("steady state"), there is little or no difference between a waterjet formed by hydraulic flip and a waterjet formed in perfectly cavitation-free process (e.g., as shown in FIG. 5*a*). As such, if the nozzle causes cavitation (FIG. 4) for the first few microseconds (or maybe milliseconds if the operating Reynolds number is less than 21250) of operation, the waterjet will not be collimated. Therefore, in applications where a collimated jet is required, even at very beginning of jet ejection (e.g., in inkjets printers), a determination of whether or not reattachment occurs inside the nozzle may be very important. In addition, besides affecting the waterjet integrity, cavitation can erode metallic surfaces (if the nozzle is made from a metallic material) and therefore, damage the nozzle shape. The collapse of the cavitation bubbles close to the nozzle wall surface generates a strong pressure wave that results in a quick deterioration of the nozzle shape (see, e.g., Dumont N., Simonin O., and Habchi C. (2001), Numerical Simulation of Cavitating Flows in Diesel Injectors by a Homogenous Equilibrium Modeling Approach, *CAV*2001).

Regardless of the above factors appearing to favor conical type nozzles, pure conical nozzles are not always an option in practice because the sharp inlet edges may not last long under high operating pressures of the water flow. However, for "micro-nozzles," manufacturing an actual "sharp-edge" cone nozzle may not be economically justified in all applications. Therefore, a capillary portion may, in actuality, remain at the inlet due to, for example, high dimensional tolerances in the manufacturing process.

In practice, waterjet instability, and therefore the consequent fluctuations in the waterjet breakup length may arise because of the structural vibration and/or flow pulsation, if the nozzle inlet is sharp (see, e.g., Ramamurthi, K., Patnaik, S. R. (2002), Influence of periodic disturbances on inception of cavitation in sharp-edged orifices, *Experiments in Fluids,* 33, 720-727). Such disturbances can cause a detached flow to reattach to the nozzle wall and start cavitation. Conventional or otherwise prior art hydroentangling jet strips made of stainless steel tend to undergo severe erosion in a relatively short period of time due to such cavitation. At higher water pressures, the jet strip or nozzles defined thereby will further tend to erode more rapidly. This degradation due to cavitation typically represents a relatively large cost in the process for replacing the jet strips, and also causes an undesirable stoppage in the production line.

Thus, there exists a need for a hydroentangling jet strip device having one or more orifices, wherein orifice erosion and jet strip durability (service life) are improved over existing jet strip configurations.

SUMMARY OF THE INVENTION

The above and other needs are met by the present invention which, in one embodiment, provides a hydroentangling jet strip device, comprising a plate member having opposing sides and defining at least one nozzle orifice extending between the opposing sides. Each of the at least one nozzle orifice includes an axially-extending capillary portion having an aspect ratio, between a length of the capillary portion and a diameter of the capillary portion, wherein the aspect ratio is less than about 0.70 so as to be capable of providing a cavitation-free constricted waterjet. In one instance, the aspect ratio is about 0.62. In other instances, the fluid inlet entrance sharpness ratio is less than or equal to about 0.06. In another embodiment, the plate member may comprise two or more juxtaposed strip portions, wherein the strip portion comprising the fluid inlet is comprised of a harder material than the other strip portions. Alternatively, one or more surfaces of the plate member may be coated with a hard coating.

Accordingly, embodiments of the present invention provide significant advantages as discussed herein in further detail.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 1 schematically illustrates a portion of a prior art cone-capillary type hydroentangling nozzle jet strip, each nozzle having an inlet diameter, d≈128 microns, an outlet diameter, D≈340 microns, and a strip thickness, l=1 mm, so as to form an aspect ratio of one;

FIGS. 2*a* and 2*b* illustrate both constricted (a) and non-constricted (b) prior art waterjets issued at different Reynolds numbers of 21250, 23900, and 26200 (from left to right);

FIGS. 3*a*-3*e* illustrate a constricted prior art waterjet issued at Reynolds number of 21250 (a), wherein high-speed images shown next to the central image show that the apparently unbroken portion of the jet actually consists of a continuous wavy region (b) and a discrete (droplet stream) region (c); wherein (d) illustrates a secondary breakup (e.g., a bag breakup) of a typical droplet shown in (c); and (e) illustrates the spray region shown in the central image (a);

FIG. 4 illustrates a time sequence of water flow into an initially air-filled cone-capillary type prior art nozzle (Reynolds number of 21250), wherein separation and reattachment of the water flow is indicated;

FIGS. 5*a* and 5*b* illustrates a time sequence of water flow into an initially air-filled cone type prior art nozzle (a), indicating flow separation, for a Reynolds number of 21250, wherein velocity vectors (b) show recirculation of air inside the nozzle;

Figure 10:
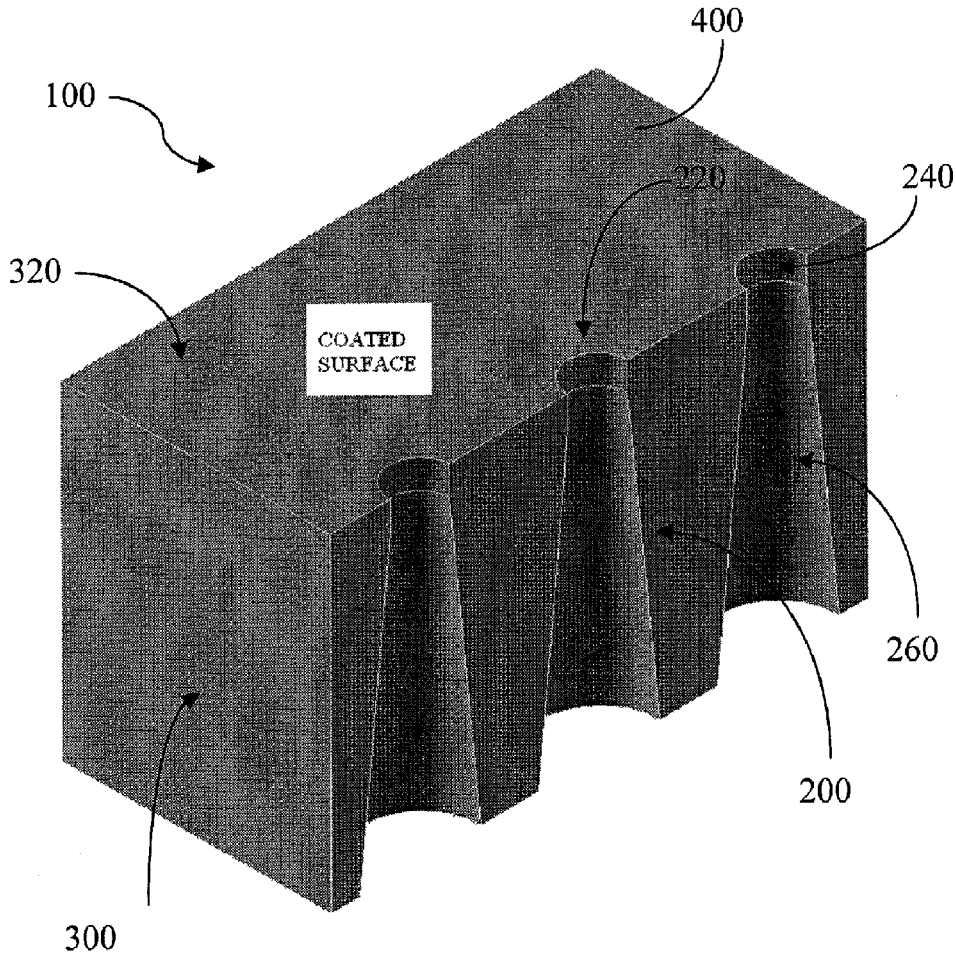
Figure 11A:
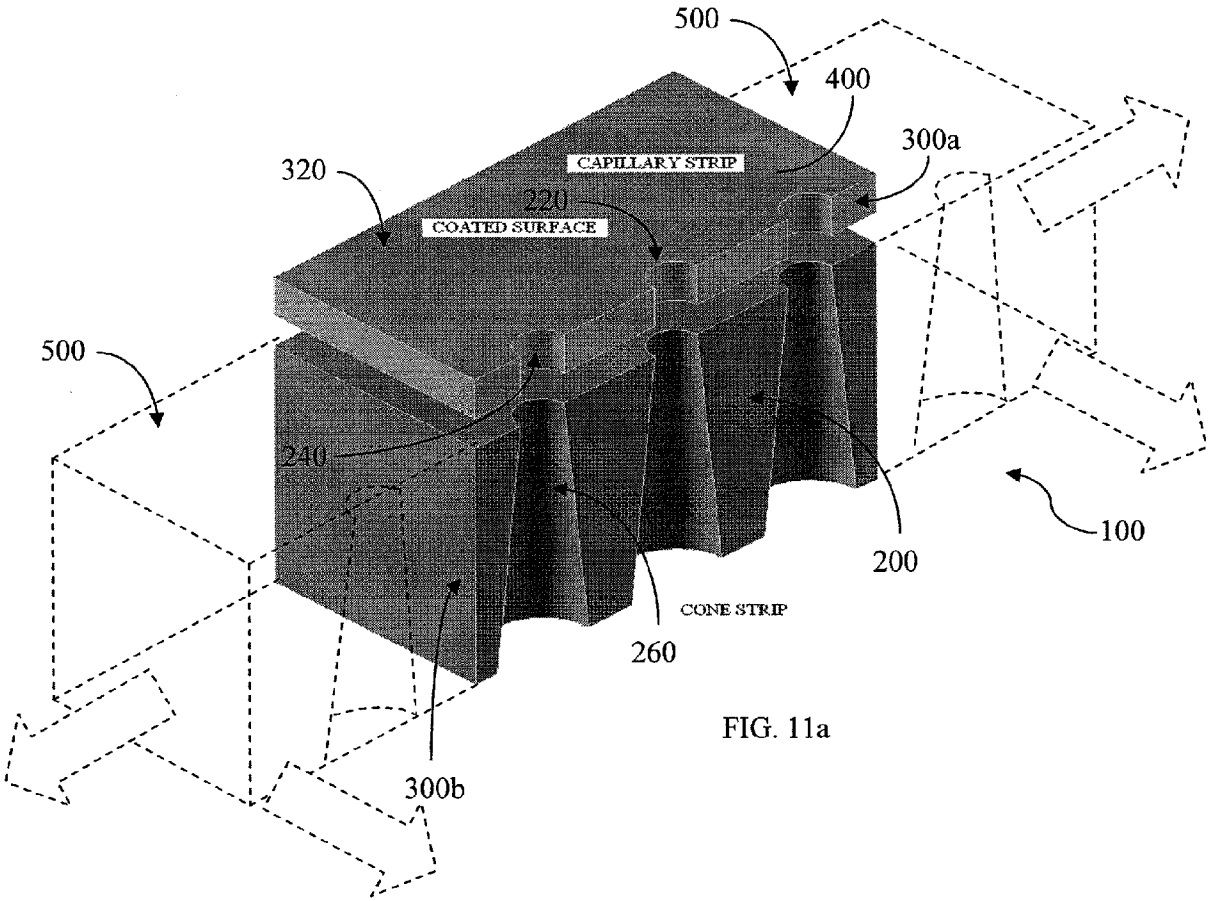
Figure 11B:
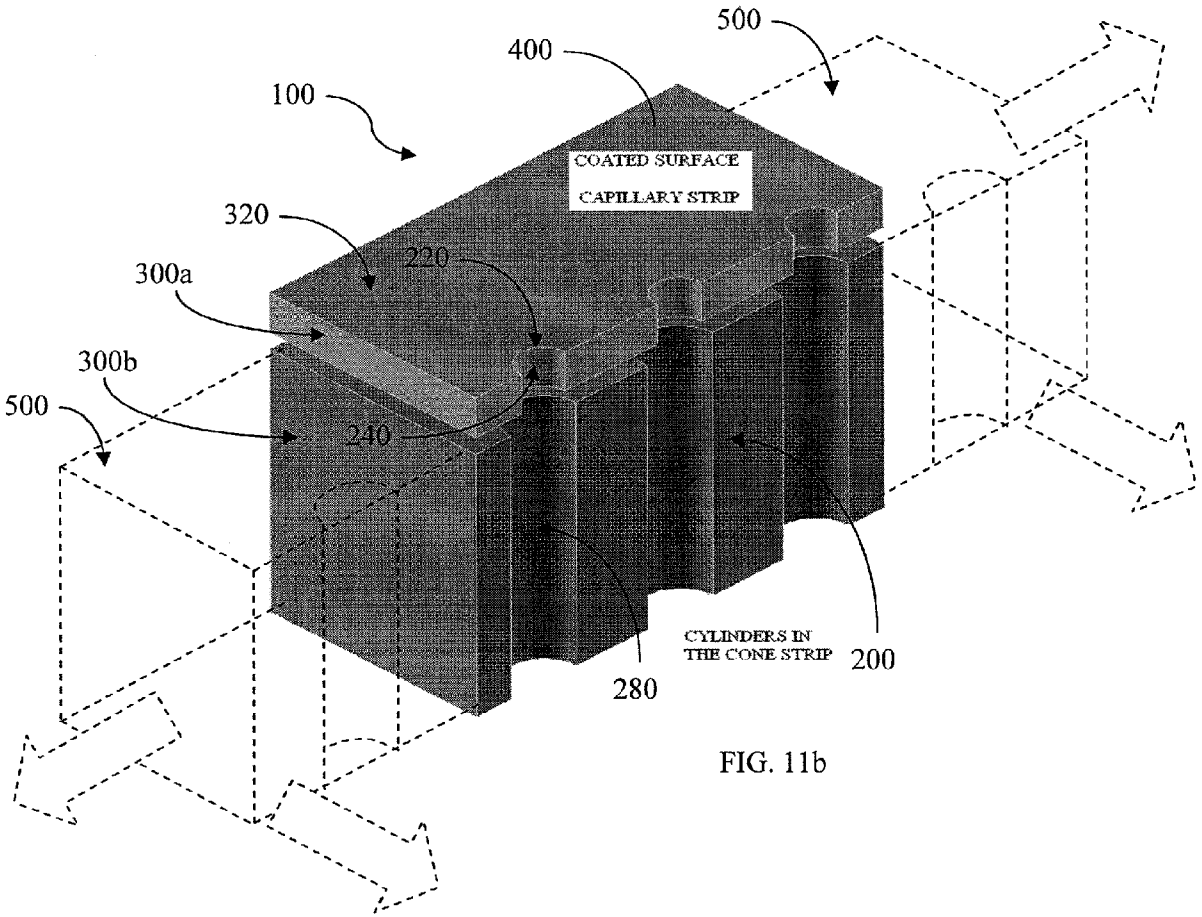

FIG. 10 illustrates a hydroentangling jet strip according to one embodiment of the present invention, wherein the capillary portion of the nozzle has an aspect ratio of about 0.62 or less; and FIGS. 11*a* and 11*b* illustrate a composite hydroentangling jet strip, according to an alternate embodiments of the present invention, wherein the composite strip is comprised of two flat strips, one defining the capillary portion of a nozzle (fluid inlet) and the other strip (fluid outlet) defining a conical portion (FIG. 11*a*) or a further capillary portion (FIG. 11*b*) of the nozzle.

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figures 3A, 3B, 3C, 3D, 3E:
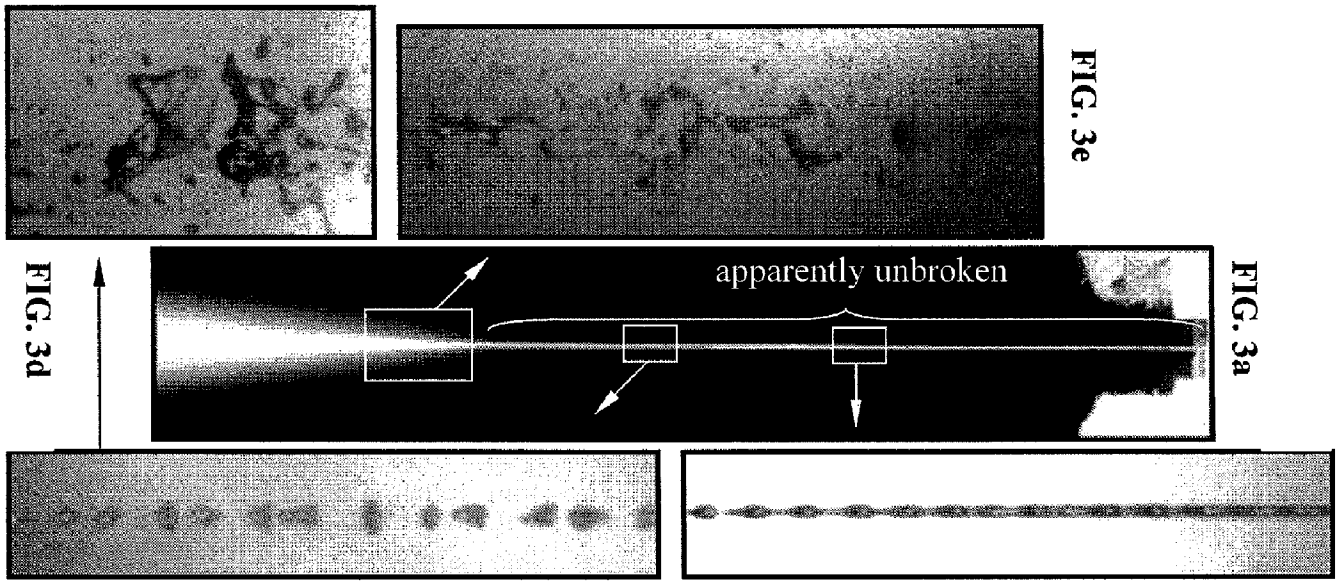
Figure 5A:
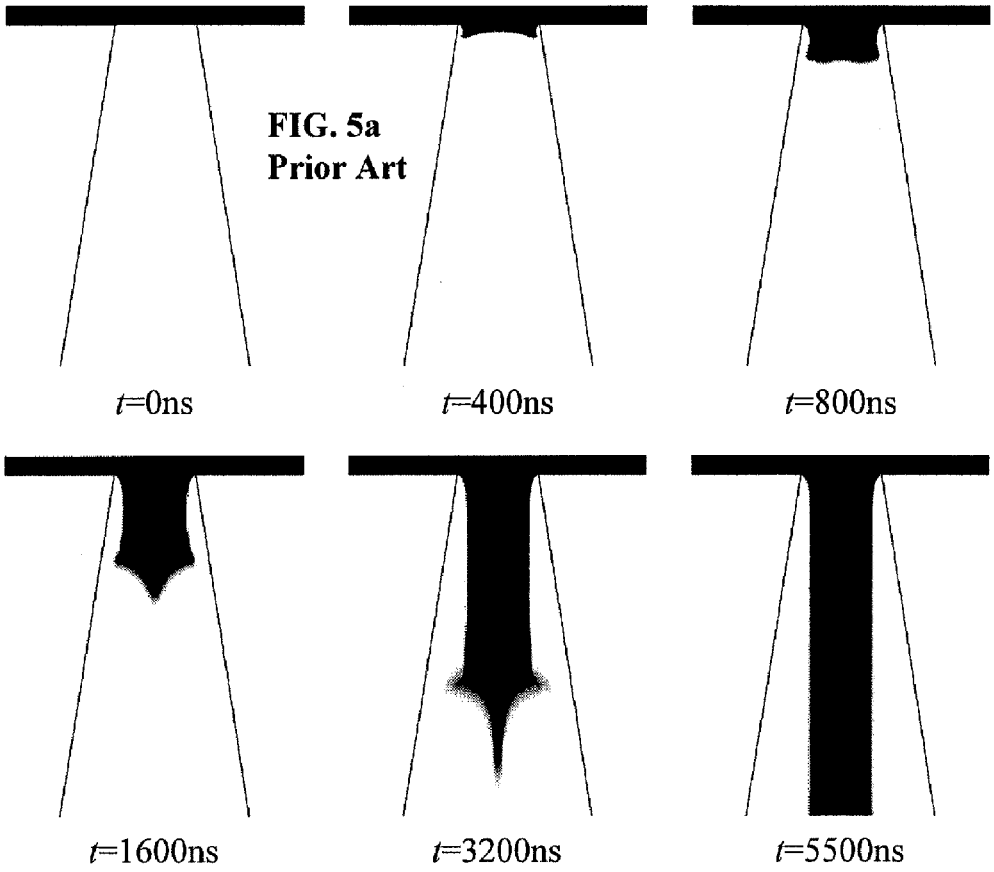
FIG. 5a Prior Art
Figure 5B:
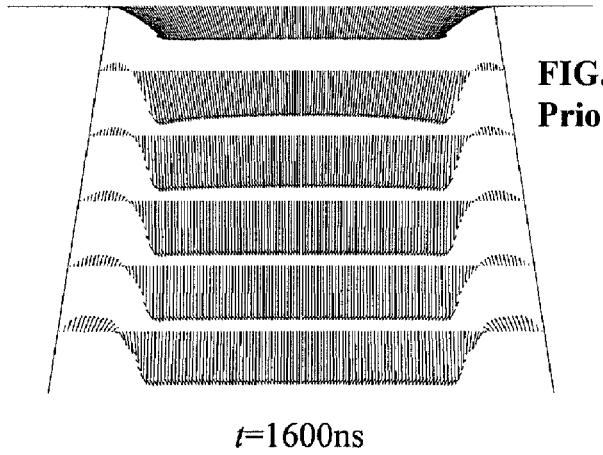
FIG. 5b Prior Art
Figure 6:
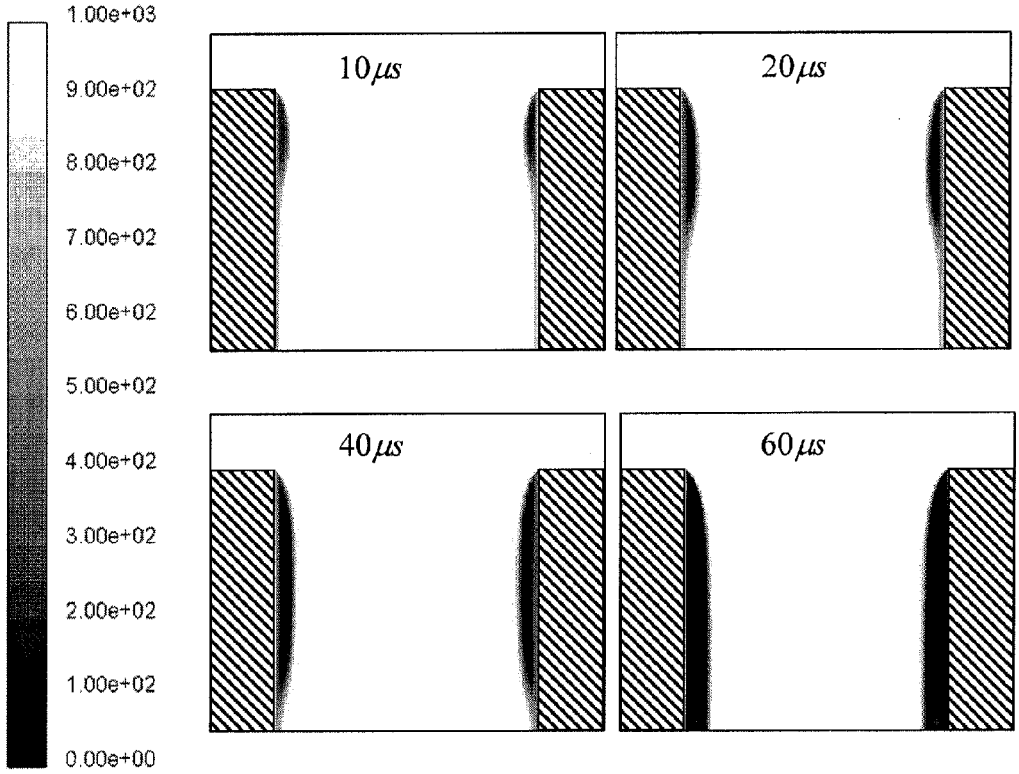
FIG. 6 illustrates contour plots of vapor-air mixture density, wherein, once the cavitation cloud reaches the outlet, hydraulic flip occurs.

A nozzle discharge coefficient was determined from each of a cone type (or "conical") nozzle and a cone-capillary type nozzle from flow simulations thereof. A discharge coefficient is the ratio of the actual (experimental) nozzle flow rate to the flow rate of the nozzle obtained for an ideal flow (e.g., from the Bernoulli equation). The simulation discharge coefficient, however, is the ratio of the mass flow rate through the nozzle obtained from a viscous flow numerical simulation to the nozzle mass flow rate obtained from the inviscid theory. A simulation discharge coefficient for the conical nozzle as shown in FIG. 5 is about 0.61 and is in agreement with available experimental studies on constricted waterjets issued from a cone-capillary type nozzles having an aspect ratio of one (see, e.g., Ghassemieh E., Versteeg H. K. and Acar M. (2003), Effect of Nozzle Geometry on the Flow Characteristics of Hydroentangling Jets, *Textile Research Journal,* 73, 5; or Begenir, A., Vahedi Tafreshi, H., and Pourdeyhimi, B. (2004) Effects of the Nozzle Geometry on Hydroentangling Waterjets: Experimental Study", *Textile Research Journal* 74(2) 178-184), as well as other works in the literature on constricted waterjet from thin-plate orifices (see, e.g., Ramamurthi, K., Patnaik 2002; and Ohrn, et al. 1991). In contrast, the discharge coefficient of a cone-capillary type nozzle, having an aspect ratio 1, changes with time. For example, the discharge coefficient for such a nozzle, at a distance of about half of the capillary length (e.g., about 64 micron) downstream of the fluid inlet may be about 0.63 before the reattachment and about 0.93 at about three microseconds after the reattachment. A discharge coefficient of about 0.93 is typical for non-constricted waterjets (see, e.g., Ramamurthi and Patnaik 2002; Ghassemieh et al 2003; and Begenir et al. 2004).

FIGS. 10 and 11 schematically illustrate various embodiments of a hydroentangling jet strip device according to the present invention, the device being indicated generally by the numeral 100. Partial cross-sections of the device 100 are shown defining a few nozzles 200. However, one skilled in the art will appreciate that such a device 100 used in a hydroentangling process often implements at least one nozzle 200, and preferably a plurality of nozzles 200, such as multiple tens, hundreds, or thousands of such nozzles 200, wherein such nozzles 200 are arranged in at least one row. The nozzles 200 are typically defined by a plate member 300, wherein such a plate member 300 may be comprised of any suitable material such as, for example, stainless steel, and otherwise configured to be capable of withstanding water pressures of at least 1000 bars, as is common in a hydroentangling process. The nozzles 200, or orifices defining such nozzles 200, may be, for example, cylindrical in shape, or comprised of a capillary portion followed by a cone portion, but having a capillary portion comprising the fluid inlet 220. According to embodiments of the present invention, the nozzles 200 have a diameter of the fluid inlet 220 (capillary portion) on the order of microns such as, for example, between about 30 microns and about 350 microns, to be capable of producing the desired waterjet. Such nozzles 200 also have a relatively sharp edge at the fluid inlet 220 or entrance so as to allow the collimation of the waterjet. That is, the capillary portion 240 includes an inlet edge curvature defined as a radius between the surface 320 of the plate member 300 and the wall of the capillary portion 240 at the fluid inlet 220, wherein the capillary portion 240 further defines an entrance sharpness ratio between the inlet edge curvature radius and the diameter of the capillary portion 240 of no more than 0.06.

Figure 7:
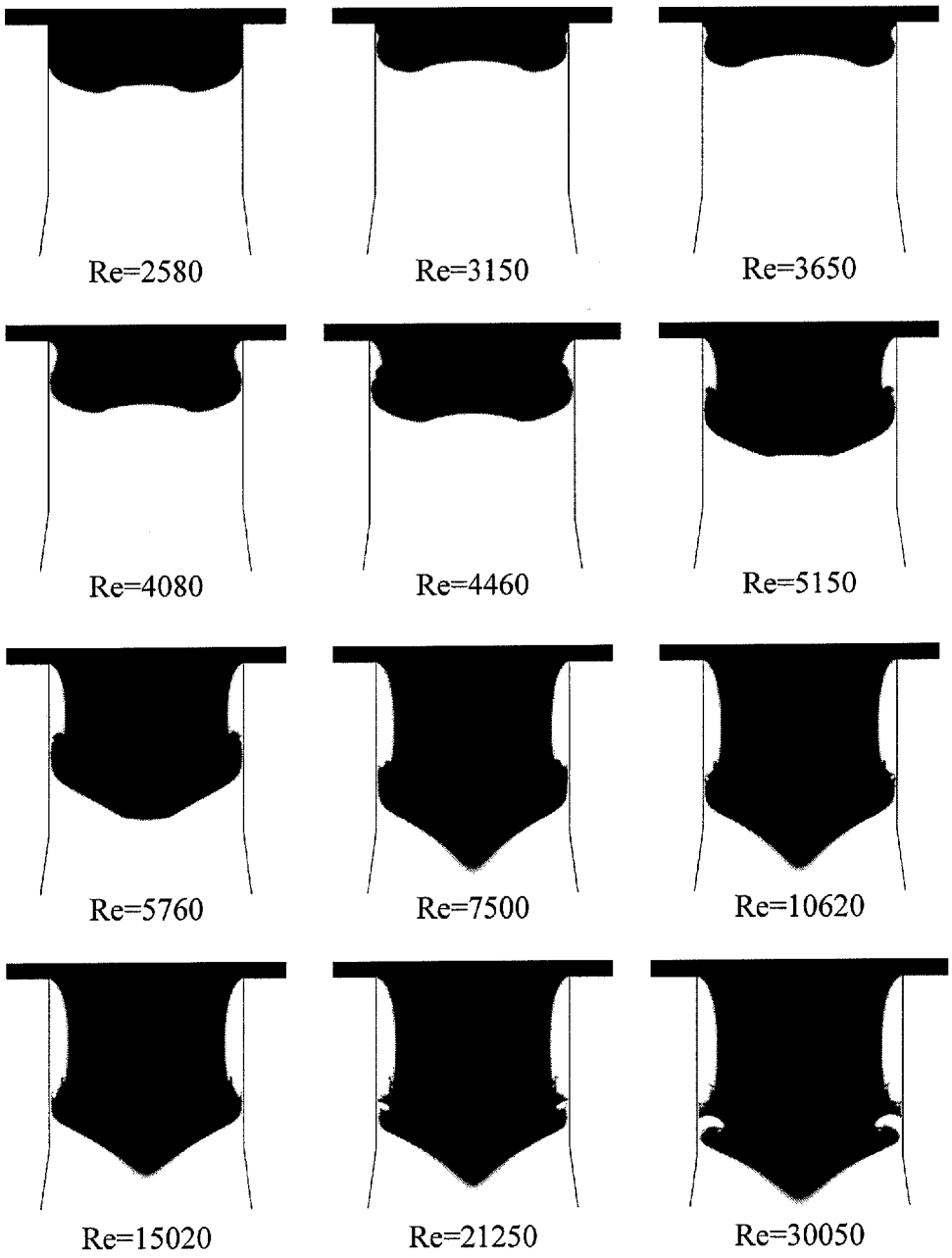
FIG. 7 illustrates water flow into a cone-capillary type nozzle, having an aspect ratio of one, at different Reynolds numbers, wherein the image for each Reynolds number is shown at the moment of water flow reattachment.

According to one aspect of the present invention, the nozzle 200 includes a capillary portion 240 having an aspect ratio of no more than 0.7, wherein, in such a configuration, the nozzle 200 is capable of producing a cavitation-free constricted waterjet similar to such a waterjet produced by a conical nozzle, but having a higher degree of erosion resistance (and thus a longer service life), particularly if the length of the capillary portion 240 is less than the reattachment length of the water flow through the nozzle 200. In the case of a relatively sharp fluid inlet 220, water flow at different pressures was simulated and the reattachment length of the waterjet calculated from the simulations. FIG. 7 shows the reattachments of waterjets in a sharp-edge cone-capillary type nozzle at different Reynolds numbers. The moment that reattachment occurs can be determined by a sudden increase (about 2 to 3 orders of magnitude) in the flow density (which is initially equal to that of air) in the cells adjacent to the nozzle wall. For the lowest Reynolds number considered in FIG. 7, there is no detachment because the flow momentum in the horizontal direction is not sufficient to separate the water flow from the vertical wall of the capillary portion 240. Upon increasing the Reynolds number, the water flow separates or detaches from the nozzle wall, but is followed by a relatively quick reattachment ($3150<Re<10{,}000$). For Reynolds numbers higher than 10,000, reattachment occurs close to the entrance to the cone portion 260 of the nozzle 200. However, further increase in the Reynolds number does not provide a significant change in the reattachment length. As such, the reattachment lengths normalized by the diameter of the capillary portion 240 are plotted in FIG. 8. Generally, it was discovered that $l_r/d_n=0.7$ seemed to serve as one limit for the reattachment length in the capillary portion 240 at high Reynolds numbers.

Figure 8:
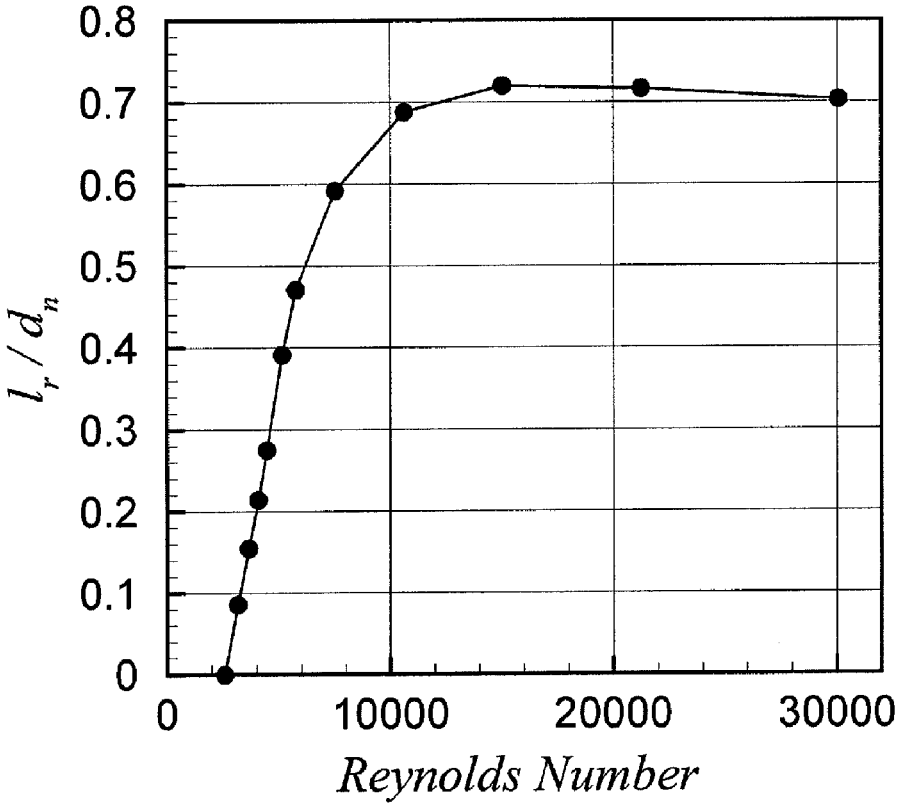
FIG. 8 is a graph illustrating normalized reattachment length versus Reynolds number for a sharp-edge cone-capillary type nozzle.
Figure 9:
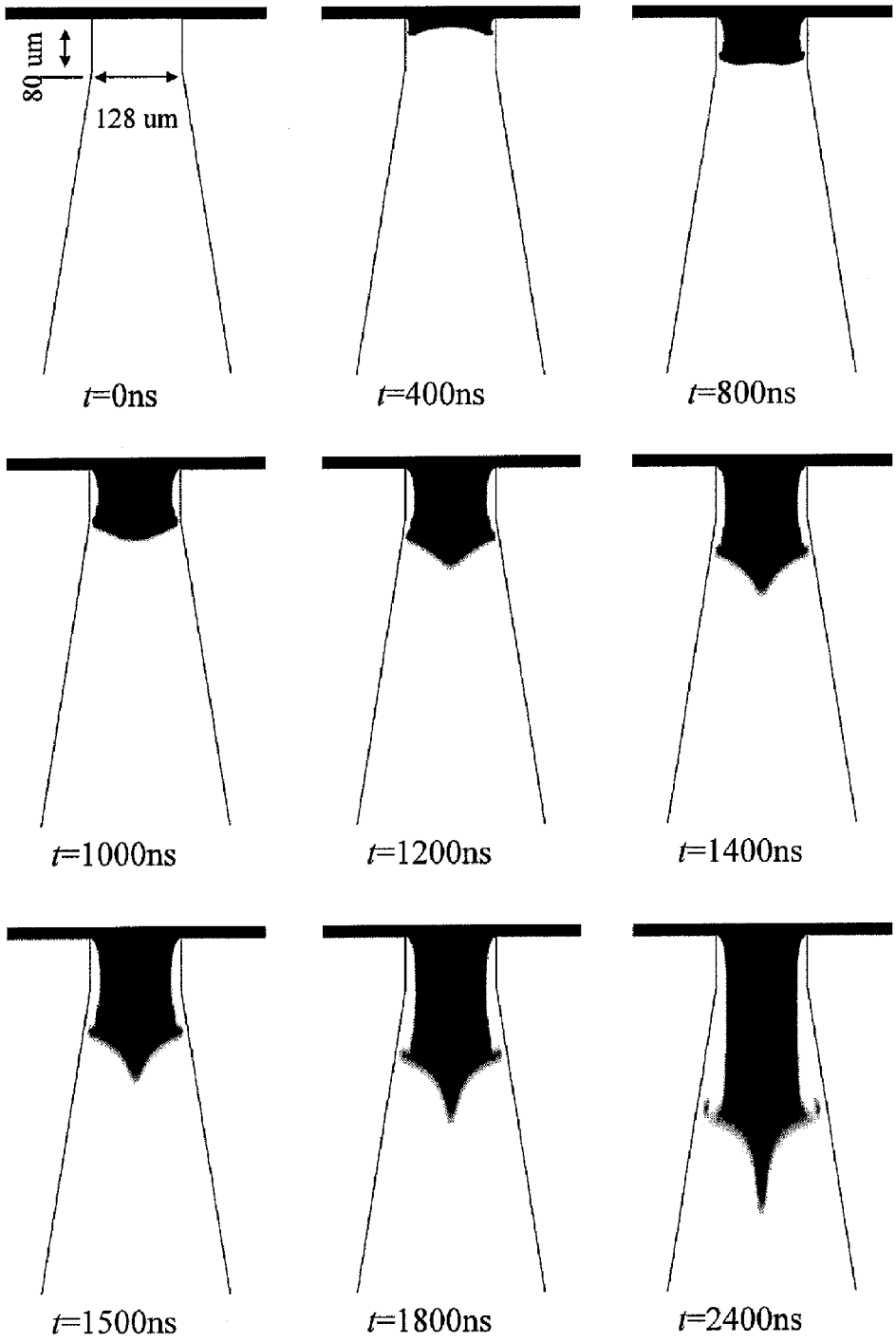
FIG. 9 illustrates a time sequence of water flow into an initially air-filled cone-capillary type nozzle having an aspect ratio of about 0.62, according to one embodiment of the present invention, wherein no reattachment is observed for an operating Reynolds number of 21250.

FIG. 8 at least partially indicates that a nozzle 200 having an aspect ratio smaller than 0.7 is capable of producing a cavitation-free constricted waterjet similar to a waterjet produced by a conical nozzle. To investigate this hypothesis, a nozzle 200 having an aspect ratio (between the length of the capillary portion 240 and the diameter of the capillary portion 240) of 0.62 was subjected to a water flow at a Reynolds number of 21250. As shown in FIG. 9, a constricted laminar waterjet is formed without any induced disturbances from the wall of the capillary portion 240 of the nozzle 200. The results thus show that the 0.62 aspect ratio cone-capillary nozzle in FIG. 9 should also be equally applicable to a cylindrical nozzle having a similar aspect ratio. FIG. 10 thus illustrates a schematic of a jet strip device 100 with a nozzle 200 having a capillary portion 240 as the fluid inlet, with a relatively sharp edge and an aspect ratio of no more than 0.70, according to one embodiment of the present invention. In some instances, a relatively hard coating 400 such as, for example, SPT HiDuraFlex HCC coating, can be applied to the surface 320 of plate member 300 comprising the nozzle 200, so as to improve the resistance of the surface 320 to erosion/corrosion or the like.

As shown in FIG. 11, a jet strip device 100 according to one embodiment of the present invention may also allow the capillary portion and the cone portion of the nozzles 200 to be formed from separate strip portions 300*a*, 300*b* that can be attached together or otherwise juxtaposed to form a composite plate member 300. As previously discussed, a majority of the erosion/corrosion effects in jet strip devices are typically expected about the fluid inlet 220 and, in the embodiments employing an initial capillary portion 240 having an aspect ratio of no more than 0.70, nozzle portions subsequent to the initial capillary portion 240 may generally not be exposed to significant wear or erosion. Accordingly, in one instance, one of the strip portions 300*a* can be configured so as to define only the capillary portion 240 of the nozzle 200, while one or more subsequent strip portions 300*b* can be configured to define the cone portion 260 of the nozzle 200 or a continuing cylindrical portion 280. In such an instance, the strip portion 300*a* defining the capillary portions 240 may be used on both (major dimension) sides since the capillary portion 240 comprises a pure cylinder. That is, should the capillary portion 240 experience wear about the fluid inlet, the strip portion 300*a* defining the capillary portions 240 may be turned over such that the side or surface previously engaging the strip portion defining the cone portion 260 or further cylindrical portion 280 now becomes the initial fluid contact surface 320. The capability of reversing this strip portion 300*a* thus increases the service life of a particular device 100. Further, such a thin strip portion 300*a* may be less costly to manufacture since the pure cylinder form of the capillary portions 240 is far less complicated than conventional capillary-cone type nozzles.

In addition, since only the strip portion 300*a* defining the capillary portion 240 of the nozzle 200 forms the constricted waterjet, there is no particular need to manufacturing a conical portion in the subsequent strip portion(s) 300*b*. Accordingly, generally any cylindrical hole having a diameter equal to or slightly larger than the diameter of the capillary portion 240 can be used as "the conical portion" of the nozzle 200 (for example, the cone portion 260, the further cylindrical portion 280, or any other suitable configuration). However, any portion of the nozzle 200 following the capillary portion 240 should not have a diameter that is overly large compared to the diameter of the corresponding capillary portion 240, so as to avoid failure of the relatively thin strip portion 300*a* defining the capillary portion 240, which may experience mechanical deformation or failure under high pressures. Accordingly, the cone portion 260 or the further cylindrical portion 280 following the capillary portion 240 cannot have an entrance or inlet diameter of more than, for example, on the order of about 50% larger than the diameter of the corresponding capillary portion 240. However, the configuration of the inlet diameter of the cone portion 260 or the further cylindrical portion 280 may depend on different factors such as, for example, spacing between the nozzles 200. Where the subsequent strip portion 300*b* defines the cone portion 260 of the nozzle, the cone portion 260 preferably has a cone angle of no more than 90 degrees.

Further, from FIGS. 11*a* and 11*b*, the composite configuration of the device 100 may also allow the strip portion 300*a* defining the capillary portion 240 of the nozzle to be comprised of a more wear resistant and harder material than found in, for example, "conventional" or otherwise prior art jet strip devices, or the other strip portion(s) 300*b*, wherein such a more wear resistant or harder material may comprise, for example, a hardened steel or other suitable materials, or combinations thereof. Alternatively, this relatively thin strip portion 300*a* may be coated with a hard coating such as, for example, the previously mentioned SPT HiDuraFlex HCC coating, a diamond-like material, a carbon-type coating, a titanium- or nickel-based coating, or any other suitable materials or combinations thereof, instead of or in addition to the strip portion 300*a* beings comprised of a harder material. The strip portion 300*a* defining the capillary portion 240 of the nozzle 200, in addition to being comprised of a harder or more wear-resistant material, or coated with a hard coating, may also comprise one or more inserts installed therein so as to form at least a part of the capillary portions 240, wherein such inserts may be comprised of, for example, sapphire, diamond, or other suitable material. As previously discussed, the initial strip portion 300*a* can thus be reversed such that the opposing side of the major dimension becomes the fluid contact surface, thereby possibly doubling the service life of the device 100 before replacement is required. Further, the subsequent strip portion 300*b* can be incorporated into many manifold configurations, wherein such a manifold 500 generally comprises an apparatus on which the jet strip device 100 is mounted (shown, for example, in phantom in FIGS. 11*a* and 11*b* as lateral extensions of the subsequent strip portion 300*b*), thereby obviating the need for the single subsequent strip portion 300*b* (such that the jet strip device 100 comprises only the initial strip portion 300*a*) and providing relatively large flexibility with respect to configurations of the jet strip device 100. Such nozzles 200 may thus provide longer continuous operation of hydroentangling machines and thereby realize significant cost savings, while also concurrently providing for greater ranges of operational parameters and improved performance.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A hydroentangling jet strip device, comprising:

a plate member having opposing sides and defining at least one nozzle orifice extending between the opposing sides, each of the at least one nozzle orifice including an axially-extending capillary portion having an aspect ratio between a length of the capillary portion and a diameter of the capillary portion, the aspect ratio being less than about 0.70 so as to be capable of providing a cavitation-free constricted waterjet.

2. A device according to claim 1 wherein the plate member defines a plurality of nozzle orifices arranged in at least one row.

3. A device according to claim 2 wherein the at least one orifice nozzle is configured so as to be capable of channeling a fluid therethrough, the fluid having a pressure of at least 1000 bars.

4. A device according to claim 1 wherein the plate member further comprises at least two discrete strip portions, the at least two strip portions being juxtaposed such that one of the at least two strip portions defines one side of the plate member and another of the at least two strip portions defines the other side of the plate member, the at least two strip portions cooperating such that the at least one nozzle orifice extends between the opposing sides.

5. A device according to claim 4 wherein the opposing sides further comprise a fluid inlet side and a fluid outlet side, further wherein the one of the at least two strip portions defining the fluid outlet side being comprised of a first material having a hardness value and the another of the at least two strip portions defining the fluid inlet side being comprised of a second material having a hardness value greater than the first material hardness value.

6. A device according to claim 5 wherein the another of the at least two strip portions defining the fluid inlet side of the plate member includes opposed major-dimension sides, and further wherein the another of the at least two strip portions is reversible such that the major-dimension side initially directed toward the fluid outlet side of the plate member can be re-oriented to define the fluid inlet side of the plate member, and whereby the other major-dimension side initially defining the fluid inlet side of the plate member is re-oriented so as to be directed toward the fluid outlet side of the plate member.

7. A device according to claim 5 wherein the another of the at least two strip portions defines the capillary portion of the at least one nozzle orifice.

8. A device according to claim 5 wherein the another of the at least two strip portions defining the fluid inlet side has opposing sides and includes a coating applied to at least one of the sides, the coating being configured to have a hardness greater than a hardness of the second material comprising the another of the at least two strip portions.

9. A device according to claim 1 wherein the aspect ratio of the capillary portion is about 0.62.

10. A device according to claim 1 where the at least one nozzle orifice further comprises an axially-extending cone portion having a smaller end and an opposed larger end, the capillary portion and the cone portion being axially arranged in series such that the capillary portion extends from one of the opposing sides to the smaller end of the cone portion and the cone portion then extends to the larger end at the other of the opposing sides, the capillary portion and the cone portion thereby form the at least one nozzle orifice.

11. A device according to claim 10 wherein the opposing sides further comprise a fluid inlet side and a fluid outlet side, further wherein the capillary portion extends through the fluid inlet side and larger end of the cone portion extends through the fluid outlet side.

12. A device according to claim 10 wherein the cone portion of the at least one nozzle orifice includes a cone wall extending between the smaller end and the larger end thereof, the cone portion further defining a cone angle between the cone wall and an axis of the cone portion, the cone angle being no more than 90 degrees.

13. A device according to claim 10 wherein the plate member further comprises two discrete strip portions, the two strip portions being juxtaposed such that one of the two strip portions defines one side of the plate member and the capillary portion of the at least one nozzle orifice, and another of the at least two strip portions defines the other side of the plate member and the cone portion of the at least one nozzle orifice, the two strip portions cooperating such that the at least one nozzle orifice is formed by the capillary portion and the cone portion and extends between the opposing sides.

14. A device according to claim 1 where the capillary portion includes an inlet extending through one of the opposed surfaces such that an inlet edge curvature is defined as a radius between the one of the opposed surface and the capillary portion at the inlet, the capillary portion further defining an entrance sharpness ratio between the inlet edge curvature radius and the diameter of the capillary portion, the entrance sharpness ratio being no more than 0.06.

15. A device according to claim 1 wherein the capillary portion of the at least one nozzle orifice has a diameter of between about 30 microns and about 350 microns.

16. A device according to claim 1 wherein the opposing sides further comprise a fluid inlet side having the capillary portion of the at least one nozzle extending therethrough, the fluid inlet side having a coating applied thereto, the coating being configured to have a hardness greater than a hardness of the fluid inlet side.

17. A device according to claim 1 further comprising a manifold member disposed adjacent to the plate member, the manifold member defining at least one of an axially-extending manifold capillary and an axially extending manifold cone, configured to be in registration with the corresponding at least one nozzle orifice, the at least one of the manifold capillary and the manifold cone having a minimum diameter no less than the diameter of the capillary portion of the at least one nozzle orifice, the at least one of the manifold capillary and the manifold cone cooperating with the capillary portion of the at least one nozzle orifice so as to provide a constricted jet from a fluid channeled therethrough.

* * * * *